United States Patent [19]

Lo

[11] Patent Number: 4,940,893

[45] Date of Patent: Jul. 10, 1990

[54] METHOD AND APPARATUS FOR FORMING COHERENT CLUSTERS

[75] Inventor: Shui-Yin Lo, Sherman Oaks, Calif.

[73] Assignee: Apricot S.A., Luxembourg, Luxembourg

[21] Appl. No.: 169,648

[22] Filed: Mar. 18, 1988

[51] Int. Cl.[5] ..... H05H 3/00

[52] U.S. Cl. ..... 250/251; 250/423 R; 250/424

[58] Field of Search ..... 250/251, 423 R, 424

[56] References Cited

U.S. PATENT DOCUMENTS 4,755,344 7/1986 Friedman et al. ..... 250/423 R 4,875,213 10/1989 Lo ..... 372/5

OTHER PUBLICATIONS

Lam et al., Physical Review D, vol. 33, No. 5, Mar. 1, 1986, pp. 1336–1343.

Feynman et al., The Feynman Lectures on Physics, pp. 21-6-21-8.

*Primary Examiner*—Jack I. Berman

*Attorney, Agent, or Firm*—Ladas & Parry

[57] ABSTRACT

Method and apparatus for forming coherent clusters. By cluster is meant an assembly of one or more atoms or molecules assembled together. The clusters are rendered coherent by a process of induced scattering.

31 Claims, 2 Drawing Sheets

METHOD AND APPARATUS FOR FORMING COHERENT CLUSTERS

BACKGROUND OF THE INVENTION (i) Field of the Invention

This invention relates to a method and apparatus for forming coherent clusters.

(ii) Prior Art

Under decreasing temperature conditions, gas condenses into liquid, and then freezes into a solid. For a molecular or atomic beam which is emitted from a nozzle, the temperature drops down rapidly. The atoms or molecules will stick together to form clusters. When the number of atoms or molecules N is greater than 100, they are called ultrafine particles. These particles occupy the boundary between the microscopic and macroscopic world and have been intensively studied. These studies are described in Physics and Chemistry of Small Clusters (NATO ASI Series B: Physics. Vol. 158), Plenum, N.Y. (1987) Edited by P. Jena, B. K. Rao and S. N. Khana; Microclusters, edited by S. Sugano, S. Okinishi Springer-Verlag, Tokyo (1987); Surface Science 156, Part 1 and 2 (1985); Surface Science 106, (1981); J. Phys. (Paris) C-2 (1977); and Chobiryushi-Science and Applications (Kagakusosetsu) (Chemical Review) Vol. 48, Chemical Society of Japan Tokyo (1985).

BRIEF DESCRIPTION OF THE INVENTION

In one aspect, the invention provides a method for forming coherent clusters comprising generating clusters and causing at least some of the clusters to become coherent.

By the term "cluster" is meant an assembly of a plurality of atoms or molecules held together. Typically, the clusters may consist of tens, hundreds or thousands of atoms or molecules.

The invention also provides apparatus for forming coherent clusters comprising means for generating clusters and coherence inducing means for causing at least some of the clusters to be coherent.

By the method and apparatus of the invention, the cluster beam may, by suitable control thereof, be formed as a coherent cluster beam. By the term "coherent cluster" in this context is meant that at least some of the atoms or molecules in the cluster concerned are coherent. That is to say the atoms or molecules share the same quantum state and are described by the same wave function. Thus a coherent cluster beam in this sense, is one in which at least some of the clusters are so coherent. However, this does not necessarily imply that these clusters are coherent amongst themselves in the sense that the aforementioned quantum state is the same for each cluster. Generally speaking, the atoms or molecules are bosons (i.e., possess integer spin).

In one form of the invention, the beam is rendered coherent by the mechanism of induced scattering. By induced scattering, the clusters may also become coherent among themselves in the sense that atoms in different coherent clusters also share the same quantum state, such as having the same energy momentum.

The coherent clusters may be formed by passage through a nozzle of a higher pressure gas whereby to form the clusters in a lower pressure region at exit from the nozzle. The coherent clusters may be neutral, positively or negatively charged. Positively charged clusters may be formed by the impact of an electron beam or other charged particles in beam form thereon. Negatively charged clusters may be formed by nucleation processes during the free expansion phase around electrons. These electrons may be generated by photoelectric effects initiated by light from a laser.

BRIEF DESCRIPTION OF THE DRAWINGS

The invention is further described by way of example only with reference to the accompanying drawings in which.

DETAILED DESCRIPTION

Figure 1:
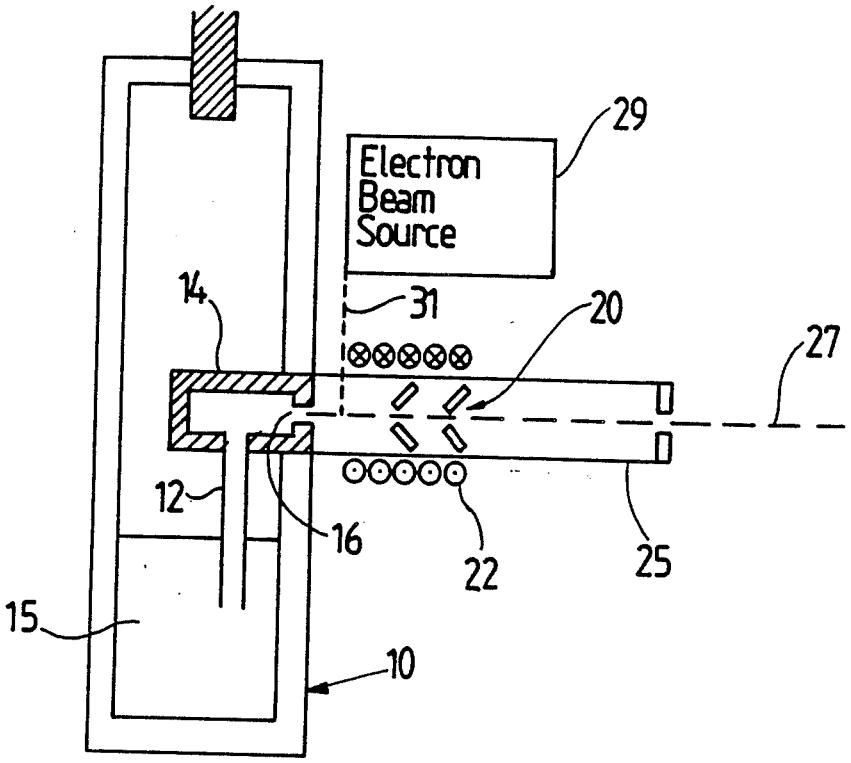
FIG. 1 is a diagram of apparatus for forming a coherent helium cluster beam in accordance with this invention.

First, it is noted that, generally in the first of two exemplary apparatuses to be described, initial helium gas is kept at high pressure, say one atmospheric pressure and at a temperature of 4° K. Then the gas is expanded through a nozzle to a vacuum. The expansion of the helium gas will cause the temperature to drop quickly below 2° K. The helium atoms will condense to form clusters. Some of the clusters will consist of coherent helium atoms, once the temperature drops below the critical temperature of 2.1° K. Hence there results a jet-like coherent neutral cluster beam.

Normally, liquid helium will have a component of superfluid once the temperature drops below the critical temperature. Here the situation is similar. The difference is that the coherent clusters form a beam and can be directed into various targets.

It is quite possible that the different clusters of helium atoms also move in the same coherent states because of the induced scattering among the various clusters, arising in analogous fashion to the mechanisms described in the specification of U.S. Application No. 035,734 incorporated herein by reference.

The scattering process is as follows:

$$He(p)+He_m(p')+He_n(p)-He(k')+He_n(p')-+He_m(p')$$

One helium atom scatters off a $He_n$ cluster with n helium atoms each at momentum p. Provided the conservation laws are satisfied, it is most likely that the $He_n(p)$ will be scattered into $He_n(p')$, with the same final momentum p' as a nearby helium cluster $He_m(p')$, which has each of its atoms in momentum state p'. In the rest frame of these coherent clusters, they appear as a superfluid liquid in droplets formed all over the beam space:

$$He_{n1}(p')+He_{n2}(p')+\ldots He_{nf}(p')$$

These coherent clusters can be measured in two ways:

(A) The energy spread $\Delta E_c$ among these coherent clusters is considerably smaller that the temperature T of the beam i.e., $\Delta E_c << T$.

The energy spread of a neutral cluster beam can be measured by ionizing the beam with an electron beam. Then the charged clusters will be accelerated, and their velocities detected by time-of-flight methods.

(B) Scattering with a laser. As mentioned in application No. 035,734 incorporated herein by reference, the induced scattering cross sections among two coherent beams of heliums and photons, $$nHe(p')+m\gamma(k)-nHe(p')+m\gamma(k')$$

is considerably bigger by a factor n!m! than that among individual helium atoms and photons. Hence by shining laser light on the coherent cluster beam, it is possible to detect a much stronger scattered photon signal than that by shining laser light on a noncoherent cluster beam.

Hydrogen cluster ions are formed by free jet expansion of weakly ionized pure hydrogen gas. This work is described in the publication by R. J. Beuhler and L. Friedman: Cluster Ion Formation in Free Jet Expansion Processes at Low Temperature. Ber. Bunsenges Phys. Chem. 88, 265–270 (1984); J. Chem. Phys. 77, 2549 (1982); J. Chem. Phys. 78, 4669 (1983). At an initial pressure $p_o=18$ cm He and source block temperature at 17° K., hydrogen cluster ions will be formed with a narrow mass distribution having m/e values of the order of 10,000.

Providing seed ions will assist the nucleation process, and a larger cluster size may result in that case.

To generate ions, microwave radiation may be used to generate ions. It is also possible to use an arc. Both of these methods will result in appearance of an unacceptable heat source for a liquid helium temperature environment. Ions may, however, be created immediately outside a nozzle by the impact of an electron beam. Ions created just outside the nozzle, will be cooled together with the neutral molecules during free jet expansion.

A coherent ion-cluster beam is preferable to coherent neutral cluster beam because one can accelerate it to higher energy. Hence, a coherent ion-cluster beam has great advantage over other coherent neutral beams. It is well known that it is extremely difficult to construct a laser emitting in X-ray region although a laser emitting invisible light has been achieved for more than a quarter of century. For the coherent ion-cluster beam, there is no difficulty in increasing its energy per particle, because it can be accelerated like any other charged beam in a linear accelerator.

An apparatus for generating a coherent cluster beam of helium is shown in more detail in FIG. 1. A cryostat 10 is used to store liquid helium 15. The liquid helium vaporizes through a tube 12 to a chamber 14 where the helium gas is stored at approximately atmospheric pressure and at liquid helium temperature 4° K. A nozzle 16 is situated at the window of the cryostat and the helium gas will expand freely through the nozzle 16 to a vacuum chamber 25 outside. An electron beam source 29 is provided to direct a beam 31 of electrons to impact on the liquid helium ions as they emerge from nozzle 16. A set of skimmers 20 placed at some distance from the nozzle serves to collimate the cluster beam 27 emerging from the nozzle, as well as to define the direction of the beam. A solenoid 22 may be positioned outside the beam, and axially surrounding the beam, so as to confine the ion-clusters. Alternatively, one may use an electrical confinement mesh to confine the ion-cluster beam. In either event, the beam 27 emerges via an aperture in the chamber 25.

The idea of confinement is to maintain the density of the ion-cluster while the neutral atoms are allowed to expand to cool. The collision among the neutral atoms and ion-clusters cools down the ion-cluster. The ion-clusters do not undergo cooling from expansion but are cooled by collision with the neutral atoms.

Figure 2:
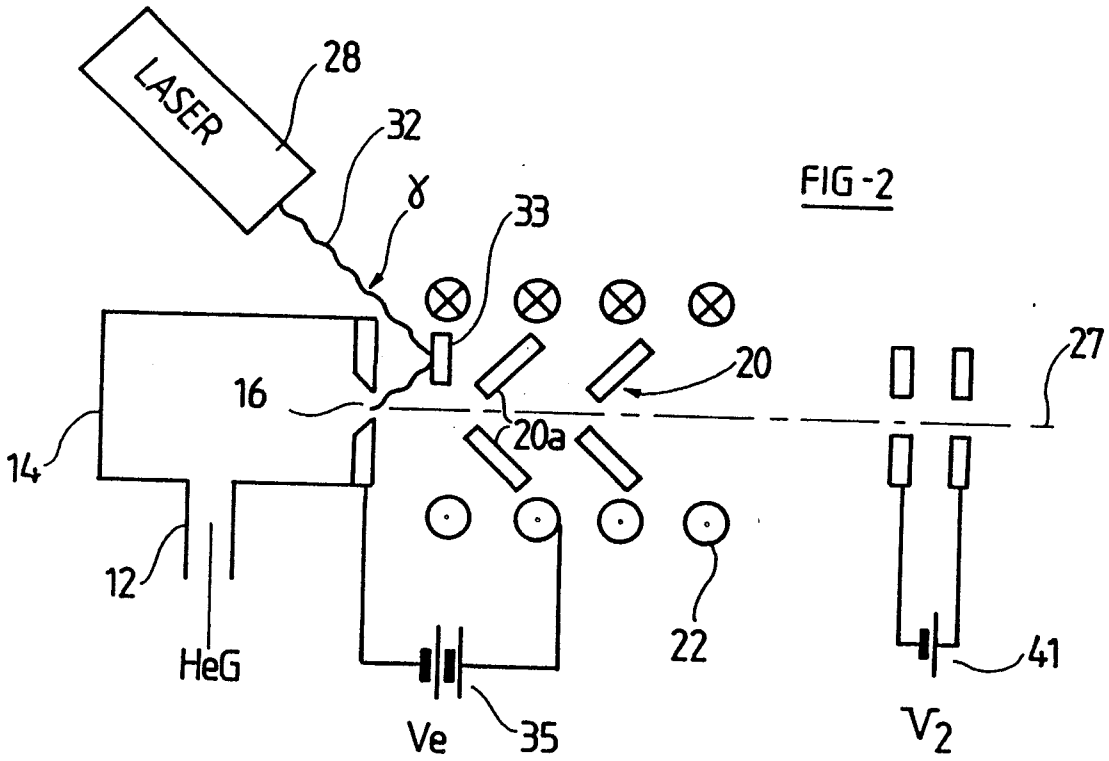
FIG. 2 is a diagram of an apparatus for forming a negatively charged cluster beam in accordance with the invention.

A different apparatus is possible to create a negatively charged coherent cluster beam. The apparatus is schematically shown in FIG. 2. Part of this apparatus is the same as shown in FIG. 1 and like reference numerals denote like components in FIGS. 1 and 2. Here a source (not shown) of He gas at temperature close to the liquid helium temperature of 4° K. and at one atmospheric pressure is again provided. The gas will pass through the nozzle 16 and expand freely in the vacuum chamber (not shown) outside the nozzle. The difference is that the nozzle, which is composed of metal in this case, is also arranged to serve as a source of electrons. Thus, a laser 28 is provided to generate a beam 32 of laser light at frequency $\omega$ which light is directed via a mirror 33 to the outside surface of the nozzle. The electrons will be emitted by photoelectric effect at energy $E_e$:

$$E_e = \frac{1}{h}\omega - \phi$$

where $\phi$ is the work function of the metal. The light from a laser has the advantage that it has sharply defined frequency $\omega$, and the electron energy spread is also small. A voltage $V_e$ is applied from a source 35 between the nozzle 16 and the first skimmer 20*a* of skimmers 20. Then, the electrons can be accelerated or decelerated by this voltage between the skimmer 20*a* and the nozzle 16. In this case, the aforedescribed source 29 of an electron beam is not provided.

The charged electrons will serve as nucleation centers for the cluster formation of helium gas as it emerges from the nozzle. Hence, there is produced a negatively charged cluster. The cooling effect of the expansion will ensure that the helium gas cluster will contain a fraction atoms at the same coherent state from Bose-Einstein condensation effect. The fraction depends on how cold the beam is. The cooler the beam, the higher the fraction of coherent particles.

The negatively charged coherent beam can further be accelerated to a higher energy by an additional extraction voltage $V_2$ provided by a source 41. It is preferred to have slower electrons, and hence a much lower value of $V_e$, just outside the nozzle, so that there will be more time for clusters to form around the electrons. In FIG. 2 an extraction voltage $V_2$ is applied across two apertured electrodes 30, 32 in the path of the outgoing beam. If achievement of a higher energy beam of coherent beam is required, the extraction voltage $V_2$ may be of different (i.e., greater) order to $V_e$.

As in the case of the apparatus of FIG. 1, the emergent cluster beam may be enclosed, immediately outside the nozzle, with a solenoid 22 so that the charged particles are confined by the magnetic field and do not suffer dilution of density.

I claim:

1. A method for forming coherent clusters by expansion comprising: generating clusters and causing at least some of the clusters to become coherent by manipulating temperature and pressure conditions; exposing said clusters prior to about the time of creation of said clusters by expansion, to particles which cause said clusters to become charged, said exposing being done in a manner that does not destroy said clusters nor the coherence of said clusters.

2. The method claimed in claim 1 wherein electrons are directed in a beam at the clusters.

3. The method claimed in claim 2 wherein the clusters are of helium ions generated by a process including the expansion of helium gas through a nozzle into a vacuum chamber.

4. The method claimed in claim 2 wherein the clusters are of helium ions generated by a process including the expansion of helium gas through a nozzle into a vacuum chamber, and the coherent clusters are directed in a beam by at least one accelerating potential from the vacuum chamber.

5. The method claimed in claim 2 wherein the clusters are of helium ions generated by a process including the expansion of helium gas through a nozzle into a vacuum chamber, and the coherent clusters are directed in a beam by at least one accelerating potential from the vacuum chamber, and collimating means is provided for collimating the beam.

6. The method claimed in claim 2 wherein the clusters are rendered coherent among themselves.

7. The method claimed in claim 2 wherein said electrons are directed in a beam at the clusters.

8. The method claimed in claim 7 wherein the clusters are of helium ions generated by a process including the expansion of helium gas through a nozzle into a vacuum chamber.

9. The method claimed in claim 7 wherein the clusters are of helium ions generated by a process including the expansion of helium gas through a nozzle into a vacuum chamber, and the coherent clusters are directed in a beam by at least one accelerating potential from the vacuum chamber.

10. The method claimed in claim 7 wherein the clusters are of helium ions generated by a process including the expansion of helium gas through a nozzle into a vacuum chamber, and the coherent clusters are directed in a beam by at least one accelerating potential from the vacuum chamber, and collimating means is provided for collimating the beam.

11. The method claimed in claim 1 wherein the clusters are of helium ions generated by a process including the expansion of helium gas through a nozzle into a vacuum chamber.

12. The method claimed in claim 1 wherein the clusters are of helium ions generated by a process including the expansion of helium gas through a nozzle into a vacuum chamber, and the coherent clusters are directed in a beam by at least one accelerating potential from the vacuum chamber.

13. The method claimed in claim 1 wherein the clusters are of helium ions generated by a process including the expansion of helium gas through a nozzle into a vacuum chamber, and the coherent clusters are directed in a beam by at least one accelerating potential from the vacuum chamber, and collimating means is provided for collimating the beam.

14. The method claimed in claim 1 wherein the clusters are rendered coherent among themselves.

15. The method as claimed in claim 1 wherein the clusters are rendered coherent among themselves.

16. Apparatus for forming coherent clusters comprising means for generating clusters and coherence inducing means for causing at least some of the clusters to be coherent.

17. The apparatus of claim 16 wherein the coherence-inducing means comprises means for generating further particles for interacting with the clusters whereby the clusters are rendered coherent.

18. The apparatus of claim 17 wherein the means for generating clusters comprises nozzle means and vacuum chamber means arranged for direction of helium gas through the nozzle to the vacuum chamber.

19. The apparatus of claim 17 wherein the means for generating clusters comprises nozzle means and vacuum chamber means arranged for direction of helium gas through the nozzle to the vacuum chamber; wherein collimating means is provided for collimating the clusters into a beam.

20. The method claimed in claim 16 wherein the coherence-inducing means comprises a source of a beam of coherent light for direction at the clusters to cause the clusters to be rendered coherent.

21. The apparatus of claim 20, wherein the means for generating clusters comprises nozzle means and vacuum chamber means arranged for direction of helium gas through the nozzle to the vacuum chamber.

22. The apparatus of claim 20 wherein the means for generating clusters comprises nozzle means and vacuum chamber means arranged for direction of helium gas through the nozzle to the vacuum chamber; wherein collimating means is provided for collimating the clusters into a beam.

23. The apparatus of claim 16, wherein the means for generating clusters comprises nozzle means and vacuum chamber means arranged for direction of helium gas through the nozzle to the vacuum chamber.

24. The apparatus of claim 16, wherein the means for generating clusters comprises nozzle means and vacuum chamber means arranged for direction of helium gas through the nozzle to the vacuum chamber; wherein collimating means are provided for collimating the clusters into a beam.

25. The method of claim 4 wherein said nozzle serves as the source of said electrons.

26. The method of claim 1 wherein said particles have a very low energy to enable adequate time for the clusters to form therearound.

27. The method of claim 1 wherein the clusters are generated by passing a material through a nozzle into a vacuum, said nozzle maintaining the material at a pressure higher than the vacuum pressure so that said clusters are formed by the expansion of the material as it moves from said nozzle to said vacuum.

28. The method of claim 27 wherein said nozzle serves as a source of said particles.

29. The method of claim 27 wherein said particles have a very low energy so that there is adequate time for said clusters to form around said particles.

30. The method of claim 1 wherein at least some of said clusters are coherent amongst themselves as well as coherent within themselves.

31. The method claimed in claim 2 wherein said electrons are released from a target in the vicinity of the clusters by means of a beam of coherent photons directed at said target.

* * * * *

UNITED STATES PATENT AND TRADEMARK OFFICE

CERTIFICATE OF CORRECTION

PATENT NO. : 4,940,893

DATED : July 10, 1990

INVENTOR(S) : Shui-Yin Lo

It is certified that error appears in the above-identified patent and that said Letters Patent is hereby corrected as shown below:

In column 2, at line 44, after "$He_n$(p) change "-" to → -- and after "$He_n$(p)" delete "-".

In column 4, at line 60, in claim 1, add --to-- after the words "said clusters prior to".

In column 4, in lines 65 and 66, in claim 2, delete "electrons are directed in a beam at the clusters" and add --said particles are electrons--.

In column 5, at line 14, in claim 6, please change "2" to --1--.

In column 5, at lines 35, 39, and 45, please, in each instance, change "1" to --2--.

In column 5, at lines 54 and 55, delete "15. The method as claimed in claim 1 wherein the clusters are rendered coherent among themselves."

In column 6, at line 3, please change "17" to --19--; in line 31, please change "16" to --17--; and at line 37, please change "4" to --16--.

UNITED STATES PATENT AND TRADEMARK OFFICE

CERTIFICATE OF CORRECTION

PATENT NO. : 4,940,893

DATED : July 10, 1990

INVENTOR(S) : Shui-Yin Lo

It is certified that error appears in the above-identified patent and that said Letters Patent is hereby corrected as shown below:

In column 6, at lines 13, and 37, please change "method" to --apparatus--.

Signed and Sealed this

Fourteenth Day of July, 1992

*Attest:*

DOUGLAS B. COMER

*Attesting Officer*

*Acting Commissioner of Patents and Trademarks*